US005237301A

United States Patent [19]

Unkelbach et al.

[11] Patent Number: 5,237,301

[45] Date of Patent: Aug. 17, 1993

[54] MAGNET SYSTEM

[75] Inventors: Karl H. Unkelbach, Cologne; Hans D. Wasmuth, Essen, both of Fed. Rep. of Germany

[73] Assignee: Kloeckner-Humboldt-Deutz AG, Fed. Rep. of Germany

[21] Appl. No.: 765,260

[22] Filed: Sep. 25, 1991

[30] Foreign Application Priority Data

Sep. 29, 1990 [DE] Fed. Rep. of Germany ..... 4030886
Oct. 15, 1990 [DE] Fed. Rep. of Germany ..... 4032616

[51] Int. Cl.[5] ..... H01F 7/02
[52] U.S. Cl. ..... 335/306; 335/302
[58] Field of Search ..... 335/302-303, 335/304, 305, 306

[56] References Cited

U.S. PATENT DOCUMENTS 4,538,130 8/1985 Gluckstern et al. ..... 335/306
4,639,673 1/1987 Zijlstra ..... 335/306
4,758,813 7/1988 Holsinger et al. ..... 335/306
4,998,034 5/1991 Hashimoto et al. ..... 335/306

*Primary Examiner*—Lincoln Donovan
*Attorney, Agent, or Firm*—Hill, Steadman & Simpson

[57] ABSTRACT

A magnet system such as for magnetic separators including uniformly magnetized arcuately positioned magnet blocks, the magnetization direction of the blocks being differently aligned relative to one another and defined according to a predetermined mathematical equation wherein the blocks are arranged in an arcuate path about a center and the magnetic orientation of the blocks is arranged according to the formula $\psi_1 = -n\phi_1$ in one arrangement.

8 Claims, 3 Drawing Sheets

MAGNET SYSTEM

BACKGROUND OF THE INVENTION

The invention relates to improvements in magnet systems and particularly to a magnet system for use in a magnetic separator wherein a plurality of individual magnet blocks are arranged according to a predetermined mathematical formula.

German Published Application 36 37 200 discloses a magnet block arrangement having outwardly directed magnetic field, whereby the magnetization directions of the annularly arranged magnet blocks are differently aligned compared to one another and are defined according to the mathematical equation $\psi_1 = -n\phi_1$. The magnet blocks are thereby fashioned with a trapezoidal cross section and care must therefore be exercised when assembling these magnet blocks that the magnetization direction of the individual magnet blocks respectively corresponds to the result calculated according to this equation. As a result of this known fashioning and arrangement of these magnet blocks, a field strength distribution in the outer region of the magnet blocks is achieved that is optimum for the number of poles required.

FEATURES OF THE INVENTION

On the basis of this known magnet system, an object of the invention is comprised in a further improvement or simplification of this magnet system, particularly with respect to the manufacture and assembly thereof.

A further object of the invention is to provide an improved magnet system and method of arranging individual magnets which constitute improvements over arrangements heretofore available and are particularly suitable for systems such as magnetic separation devices.

A feature of the invention is achieved in that the magnet blocks are in cross section. As a result of this fashioning of the magnet blocks, all magnet blocks during manufacture can be uniformly pressed, sintered and magnetized with one and the same magnetization directed perpendicularly of their axis. A considerable simplification in manufacture is achieved as a result thereof in comparison to the previously known, trapezoidally fashioned magnet blocks whereof each and every individual block must already be provided with a specific magnetization direction deviating from the other blocks during manufacture. The assembly of the inventive magnet blocks to form a magnet system is also facilitated in that the magnet blocks need merely be turned such around their axis when being assembled into position so that their magnetization direction corresponds to the direction of the mathematical equation $\psi_1 = \pm n\phi_1$. They are then fixed on a base member in this position. The magnet blocks all represent one and the same type and can therefore also be arbitrarily interchanged with one another during assembly.

When the magnet system should provide an outwardly directed magnetic field, the magnet blocks have their magnetization direction aligned according to the mathematical equation $\psi_1 = -n\phi_1$ when assembling the magnet system. The magnet blocks have their magnetization direction aligned according to the mathematical equation $\psi_1 = +n\phi_1$ during assembly of the magnet system when a magnet system having an inwardly directed magnetic field is required.

Other objects, advantages and features will become more apparent with the teaching of the principles of the invention in connection with the disclosure of the preferred embodiments in the specification, claims and drawings, in which:

DESCRIPTION OF THE PREFERRED EMBODIMENTS

Figure 1:
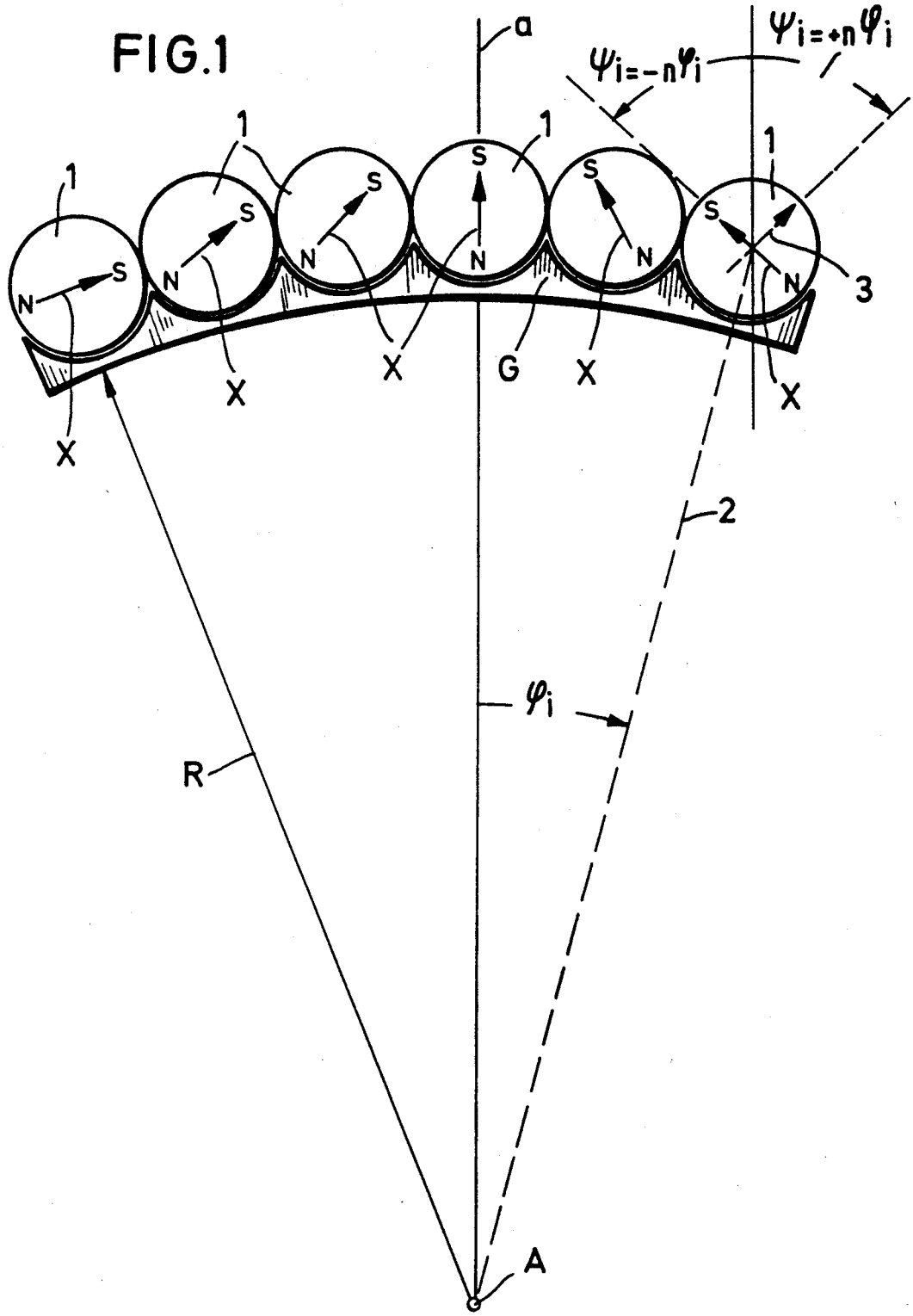
FIG. 1 is a somewhat schematic elevational view of a magnet system constructed and positioned in accordance with the features of the invention.

As FIG. 1 shows, the magnet system is comprised of magnet blocks 1 fashioned circular in cross section that are arcuately or annularly arranged at a radius R with reference to the center of the arc. The center A may be the axis A of a magnetic drum separator. The magnetization directions, arrowed lines X, of the magnet blocks 1 are differently aligned relative to one another and are defined according to a predetermined mathematical equation. The blocks are fixed on a base member G. A radial line is shown at a passing through the center A. The magnetization direction of the $i^{th}$ magnet block 1 lying on line a and having the zero angular position thus forms the angle $\psi_1 = -n\phi_1$, where n is a positive number and $\phi_1$ is the angle that is described by the vertical connecting line 2 through the center of gravity of the $i^{th}$ magnet block (i is a serial number designating the particular block) and the center axis line a. a is formed by an arbitrarily predetermined, defined radius vector. $\psi_1$ is to be indicated like $\phi_1$, that is, in the same rotational sense proceeding from the same zero angular position as radius a.

The circular cross sectional shape of the magnet blocks 1 of the invention has the special advantage that they can all be uniformly fabricated with respect to their magnetization direction and that th magnet blocks merely have to be rotated around their axis when in assembly. These magnet blocks then form a magnet system that their magnetization directions (arrows X) correspond to the predetermined mathematical equation.

In the magnet system illustrated in FIG. 1, the magnet blocks 1 have their magnetization direction (arrow X) aligned according to the mathematical equation $\psi_1 = n\phi_1$. As a result of the alignment of the magnet blocks 1 according to this equation, only an outwardly directed magnetic field that is uniform over the entire region of the magnet system is built up. When, however, an inwardly directed, uniform magnetic field is to be built up with this magnet system, the magnet blocks 1 merely have to have their magnetization direction (arrow 3) aligned according to the mathematical equation $\psi_1 = +n\phi_1$, which can be very easily accomplished by merely rotating the magnet blocks.

Figure 2:
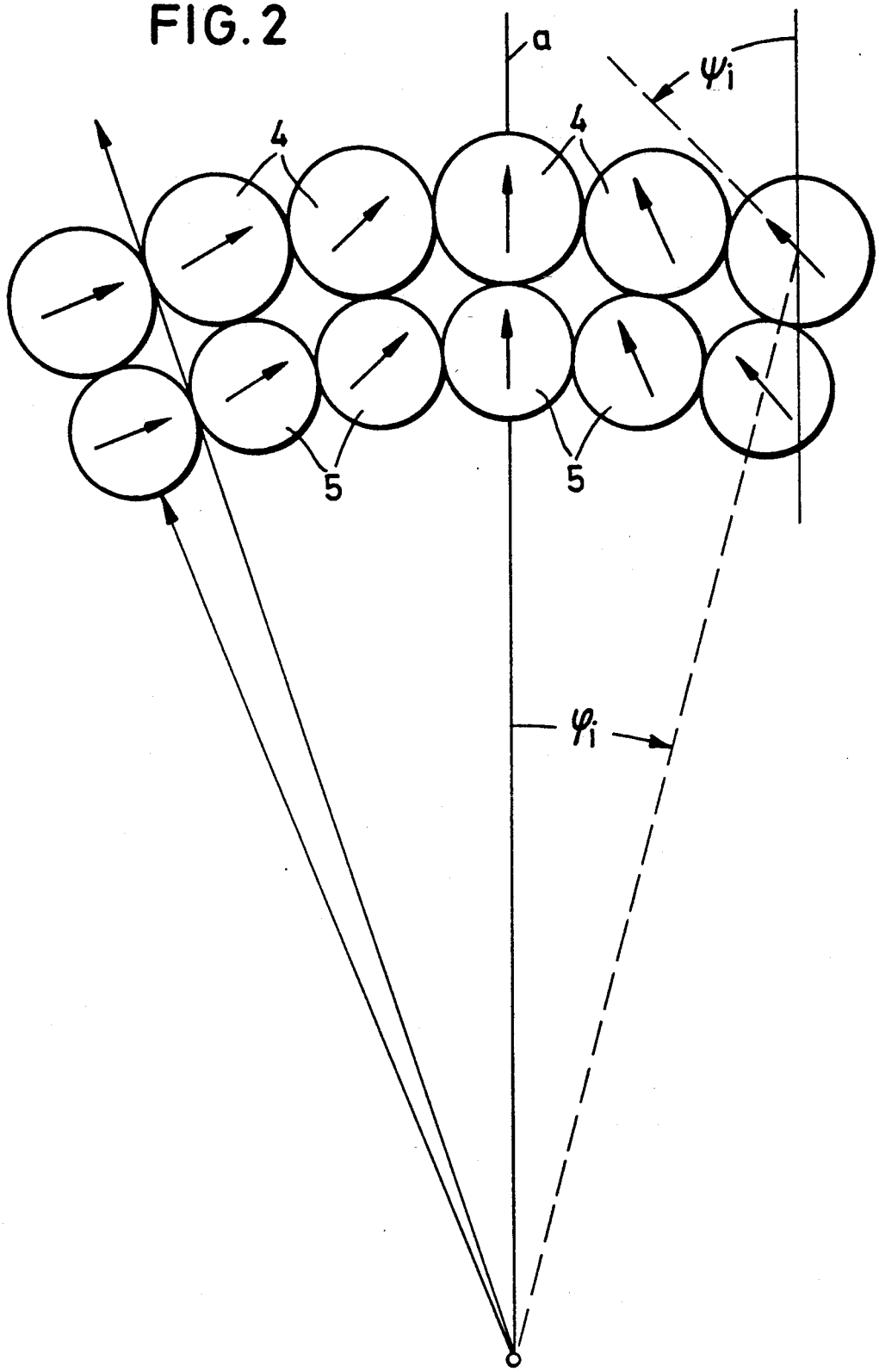
FIG. 2 is a somewhat schematic view of another magnet system arranged in accordance with the principles of the present invention.

In the magnet system shown in FIG. 2, the magnet blocks 4, 5 are arranged in two rows. A corresponding increase in the magnetic field strength is thereby very advantageously achieved. The magnet blocks 4 and 5 are thereby also arranged such and their magnetization directions are aligned such relative to one another that an outwardly directed magnetic field is generated as a result. An inwardly directed magnetic field can thereby also be built up very easily by turning the magnet blocks 4 and 5, namely such that their magnetization direction corresponds to the mathematical equation $\psi_1 = +n\phi_1$. Such magnet systems having inwardly directed magnetic field are utilized in tomographs, storage rinqs, etc., whereas magnetic systems having an outwardly directed magnetic field are mainly employed in magnetic separators, particularly magnetic drum separators.

Figure 3:
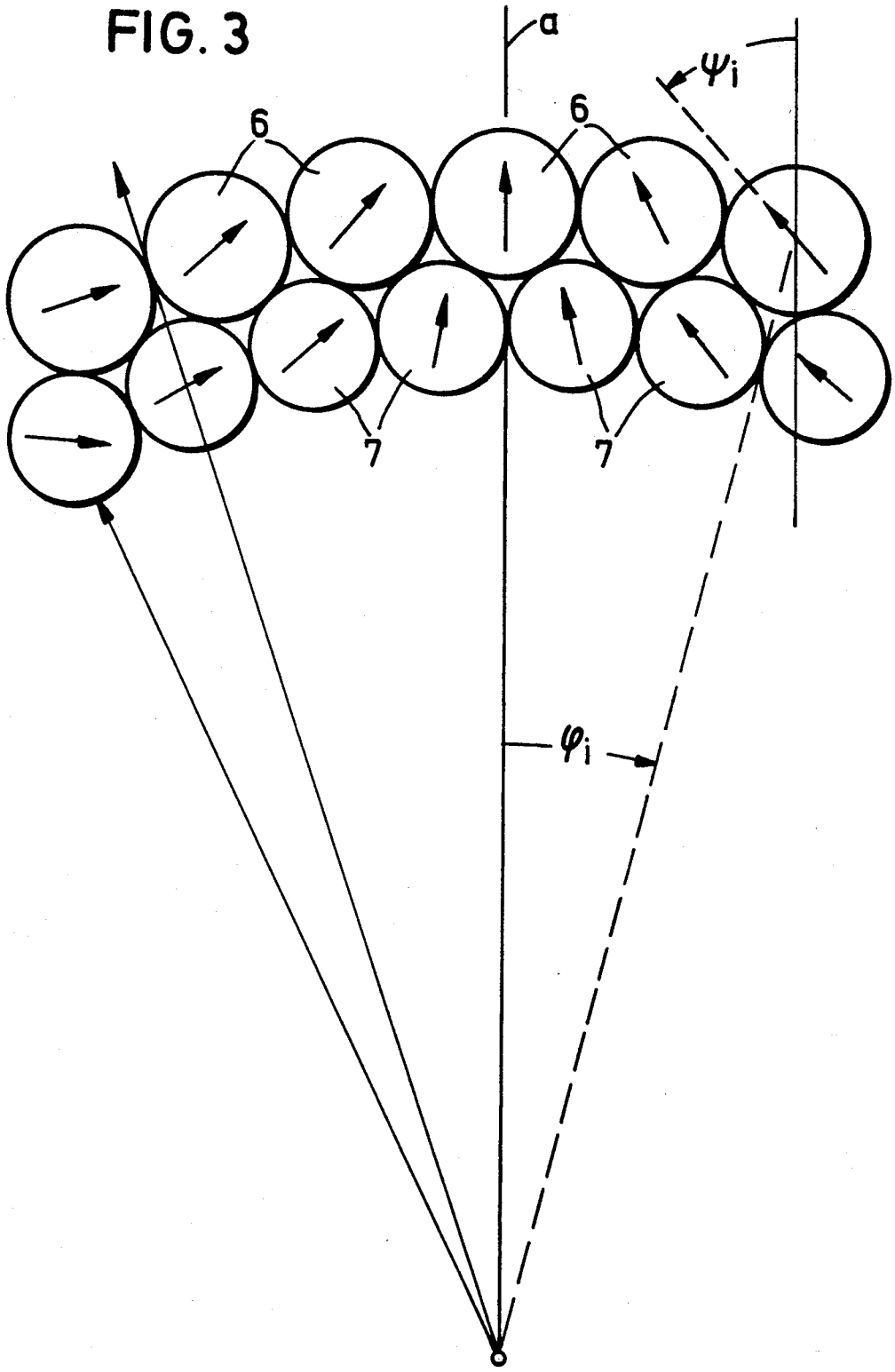
FIG. 3 is another somewhat schematic view illustrating still another arrangement of magnets in accordance with the principles of the present invention.

In the arrangement of each of FIGS. 1, 2 and 3, the magnets are preferably arranged contiguously. Where dual rows are provided such as in FIG. 2, both circumferentially adjacent magnets and radially adjacent magnets are touching so that the magnets are slightly larger in size in the outer row than in the inner row. FIGS. 2 and 3 illustrate two rows where it will be understood that additional rows may be provided as circumstances dictate.

In the magnet system shown in FIG. 3, the magnet blocks 6 and 7 are arranged in succession in two rows utilizing the magnet system principles according to FIG. 1. The difference is that the magnet blocks 7 of the inner row are offset relative to the outer row of magnet blocks 6 into the gaps situated therebetween and their magnetization directions do not proceed parallel to one another as given the magnet system shown in FIG. 2 but are respectively aligned proceeding according to the mathematical equation $\psi_1 = \pm n\phi_1$. The advantage of this magnet system is comprised in the more compact structure and in the higher magnetic field strength.

The magnet systems shown in FIGS. 1 through 3 of the drawing involve arrangements of uniformly magnetized magnet blocks as ar particularly utilized in magnetic drum separators. For the magnet systems shown in the FIGURES of the drawing, as a preferred example, $n = 3.33$, i.e. is not a whole number.

The inventively arranged magnet blocks can also extend over the entire circumference of a circle, whereby n must then be a whole number. A magnet system having fully circularly arranged magnet blocks and having an outwardly directed magnetic field is particularly employed in belt type magnetic separators, whereas a magnet system having fully circularly arranged magnet blocks and an inwardly directed magnetic field is utilized in tomographs, storage rings, etc. The magnet blocks can also comprise the cross sectional shape of a regular polygon, providing the same advantages, and can be arranged in succession in more than two circular rows as needed and can be designed with an outwardly and/or an inwardly directed magnetic field. The subject matter of the invention is therefore not limited to the magnet systems shown in the exemplary embodiments.

It will be understood that while the preferred arrangement of magnets is arcuate or circular, that an arrangement which is substantially arcuate or circular, i.e., polygonal, falls within the concepts of the invention.

Thus, there has been provided an improved magnet system and method of arranging individual magnets which achieves the objectives and advantages above set forth and provides an arrangement which is particularly susceptible of practical and useful commercial utilization.

We claim as our invention:

1. A magnet system such as for magnetic separators comprising in combination:

a plurality of uniformly magnetized magnet blocks;

the magnetic directions of the blocks being differently aligned relative to one another and relative to a radial line from a center according to a predetermined mathematical equation;

said blocks are differentially aligned according to the mathematical equation $\psi_1 = -n\phi_1$ where $\psi_1$ is the angle between the radial line and the magnetization direction of the block and wherein the magnetization direction acts toward the outside relative to said center;

$\phi_1$ is the angular location of the block relative to said radial line;

and n is the number designation of the block.

2. A magnet system such as for magnetic separators constructed in accordance with claim 1:

wherein the blocks are arranged in at least two annular rows.

3. A magnet system such as for magnetic separators constructed in accordance with claim 1:

wherein the blocks are arranged in annular rows of different distances from said center.

4. A magnet system such as for magnetic separators constructed in accordance with claim 3:

wherein the individual blocks of each row are on a radial line different than the blocks of adjacent rows.

5. A magnet system such as for magnetic separators constructed in accordance with claim 3:

wherein the block of adjacent rows lie on radial lines so as to be in alignment.

6. A magnet system such as for magnetic separators constructed in accordance with claim 3:

wherein the blocks of adjacent rows are touching.

7. A magnet system such as for magnetic separators constructed in accordance with claim 2:

wherein the blocks are constructed to be circular in cross section.

8. A magnet system such as for magnetic separators constructed in accordance with claim 7:

wherein the blocks are in a plurality of annular rows arranged contiguous to each other with the blocks in successive rows from said center being of increasing size.

* * * * *